US008505497B2

(12) United States Patent
Lundgreen

(10) Patent No.: US 8,505,497 B2
(45) Date of Patent: Aug. 13, 2013

(54) HEAT TRANSFER SYSTEM INCLUDING TUBING WITH NUCLEATION BOILING SITES

(75) Inventor: James M. Lundgreen, Lakeville, MN (US)

(73) Assignee: Dri-Steem Corporation, Eden Prairie, MN (US)

( * ) Notice: Subject to any disclaimer, the term of this patent is extended or adjusted under 35 U.S.C. 154(b) by 1171 days.

(21) Appl. No.: 12/270,582

(22) Filed: Nov. 13, 2008

(65) Prior Publication Data

US 2009/0166018 A1 Jul. 2, 2009

Related U.S. Application Data

(60) Provisional application No. 61/003,142, filed on Nov. 13, 2007.

(51) Int. Cl.
*F24D 17/00* (2006.01)

(52) U.S. Cl.
USPC ..... 122/15.1; 122/415; 165/173; 261/156; 126/357.1

(58) Field of Classification Search
USPC ..... 122/31.1, 32, 414, 415, 7 R, 15.1; 165/173; 261/151, 152, 153, 155, 156; 126/344, 357.1
See application file for complete search history.

(56) References Cited

U.S. PATENT DOCUMENTS 903,150 A 11/1908 Braemer
1,101,902 A 6/1914 Braemer
2,963,284 A 12/1960 Bradford
3,096,817 A 7/1963 McKenna
3,215,416 A 11/1965 Liben
3,268,435 A 8/1966 Sellin (Continued)

FOREIGN PATENT DOCUMENTS

DE 25 29 057 A1 2/1977
GB 1 444 992 8/1976

(Continued)

OTHER PUBLICATIONS

Nortec Inc., Web Page, SAM-e—Short Absorption Manifold—Submitted Drawings, Printed May 21, 2007, pp. 1-26.

(Continued)

*Primary Examiner* — Eric Keasel
*Assistant Examiner* — Ian Paquette
(74) *Attorney, Agent, or Firm* — Merchant & Gould PC

(57) ABSTRACT

A heat transfer system includes a steam chamber that communicates in an open-loop arrangement with a first steam source for supplying steam to the steam chamber, the steam chamber including a steam exit for supplying steam to air at atmospheric pressure. A heat transfer tube communicates in a closed-loop arrangement with a second steam source for supplying steam to an interior surface of the heat transfer tube, the heat transfer tube vaporizing condensate forming within the heat transfer system back to steam that is supplied to the air via the steam exit. The outer surface of the heat transfer tube is configured to contact the condensate and vaporize the condensate back into steam, wherein the heat transfer tube includes a plurality of pockets formed on the outer surface of the tube, each pocket including a pocket exit/entry portion having a smaller cross-sectional area than the cross-sectional area of the pocket at a root portion thereof adjacent the outer surface of the tube.

12 Claims, 4 Drawing Sheets

(56) References Cited

U.S. PATENT DOCUMENTS

| | | | | |
|---|---|---|---|---|
| 3,386,659 | A | 6/1968 | Rea | |
| 3,443,559 | A | 5/1969 | Pollick | |
| 3,486,697 | A | 12/1969 | Fraser | |
| 3,623,547 | A | 11/1971 | Wallans | |
| 3,635,210 | A | 1/1972 | Morrow | |
| 3,642,201 | A | 2/1972 | Potchen | |
| 3,696,861 | A | 10/1972 | Webb | |
| 3,724,180 | A | 4/1973 | Morton et al. | |
| 3,768,290 | A | 10/1973 | Zatell | |
| 3,857,514 | A | 12/1974 | Clifton | |
| 3,870,484 | A | 3/1975 | Berg | |
| 3,923,483 | A | 12/1975 | Hilmer et al. | |
| 3,955,909 | A | 5/1976 | Craig et al. | |
| 4,040,479 | A | 8/1977 | Campbell et al. | |
| RE30,077 | E | 8/1979 | Kun et al. | |
| 4,257,389 | A | 3/1981 | Texidor et al. | |
| 4,265,840 | A | 5/1981 | Bahler | |
| 4,384,873 | A | 5/1983 | Herr | |
| D269,808 | S | 7/1983 | Morton | |
| 4,438,807 | A | 3/1984 | Mathur et al. | |
| 4,660,630 | A | 4/1987 | Cunningham et al. | |
| 4,765,058 | A | 8/1988 | Zohler | |
| 4,913,856 | A | 4/1990 | Morton | |
| 4,967,728 | A | 11/1990 | Dueck | |
| 5,054,548 | A | 10/1991 | Zohler | |
| 5,126,080 | A * | 6/1992 | Morton et al. | 261/118 |
| 5,146,979 | A | 9/1992 | Zohler | |
| 5,186,252 | A | 2/1993 | Nishizawa et al. | |
| 5,277,849 | A | 1/1994 | Morton et al. | |
| 5,333,682 | A | 8/1994 | Liu et al. | |
| 5,372,753 | A | 12/1994 | Morton | |
| 5,376,312 | A | 12/1994 | Morton et al. | |
| 5,516,466 | A | 5/1996 | Schlesch et al. | |
| 5,525,268 | A | 6/1996 | Reens | |
| 5,543,090 | A | 8/1996 | Morton et al. | |
| 5,697,430 | A * | 12/1997 | Thors et al. | 165/133 |
| 5,860,279 | A * | 1/1999 | Bronicki et al. | 60/655 |
| 5,942,163 | A | 8/1999 | Robinson et al. | |
| 5,996,686 | A | 12/1999 | Thors et al. | |
| 6,065,740 | A | 5/2000 | Morton | |
| 6,092,794 | A | 7/2000 | Reens | |
| 6,167,950 | B1 | 1/2001 | Gupte et al. | |
| 6,227,526 | B1 | 5/2001 | Morton | |
| 6,371,058 | B1 * | 4/2002 | Tung | 122/488 |
| 6,378,562 | B1 | 4/2002 | Noone et al. | |
| 6,398,196 | B1 | 6/2002 | Light et al. | |
| 6,485,537 | B2 | 11/2002 | Brilmaker | |
| 6,488,219 | B1 | 12/2002 | Herr | |
| 6,631,856 | B2 | 10/2003 | Herr | |
| 6,824,127 | B2 | 11/2004 | Park et al. | |
| 6,883,597 | B2 | 4/2005 | Thors et al. | |
| 7,048,958 | B2 | 5/2006 | de Jong et al. | |
| 7,150,100 | B2 | 12/2006 | Tase et al. | |
| 7,178,361 | B2 | 2/2007 | Thors et al. | |
| 7,254,964 | B2 | 8/2007 | Thors et al. | |
| 7,744,068 | B2 | 6/2010 | Lundgreen et al. | |
| 2001/0045674 | A1 | 11/2001 | Herr | |
| 2002/0089075 | A1 | 7/2002 | Light et al. | |
| 2002/0163092 | A1 | 11/2002 | Park et al. | |
| 2004/0026539 | A1 | 2/2004 | Herr | |
| 2004/0182855 | A1 | 9/2004 | Centanni | |
| 2005/0126215 | A1 | 6/2005 | Thors et al. | |
| 2005/0212152 | A1 | 9/2005 | Reens | |
| 2006/0196449 | A1 * | 9/2006 | Mockry et al. | 122/6 A |
| 2008/0290533 | A1 | 11/2008 | Dovich et al. | |
| 2009/0121367 | A1 | 5/2009 | Lundgreen et al. | |

FOREIGN PATENT DOCUMENTS

| | | | |
|---|---|---|---|
| GB | 2 019 233 | A | 10/1979 |
| WO | WO 00/57112 | | 9/2000 |
| WO | WO 2007/099299 | A1 | 9/2007 |

OTHER PUBLICATIONS

Wolverine Tube, Inc.—Product Catalog—"Enhanced Surface Tube"—[online]—pp. 1-2, http://www.wlv.com/products/products/Enhanced/enhanced.htm.

Wolverine Tube, Inc.—Turbo-ELP—"ID/OD Enhanced Surface for Improved Boiling Heat Transfer"—[online]—pp. 1-3, http://www.wlv.com/products/products/Enhanced/TurboELP.htm.

ZOTEFOAMS Inc., ZOTEK® F—High Performance PVDF Foams—"Taking foam technology to a new level," pp. 1-4, Oct. 2009.

ZOTEFOAMS Inc., ZOTEK® F—High Performance PVDF Foams (for Aviation and Aerospace)—"Taking foam technology to a new level," pp. 1-4, Oct. 2009.

ZOTEFOAMS Inc., ZOTEK® F—High Performance PVDF Foams (for Buildings and Construction)—"Taking foam technology to a new level," pp. 1-2, Oct. 2009.

ZOTEFOAMS Inc., ZOTEK® F—High Performance PVDF Foams (New Light Weight Materials—Inspiration for Design Innovation)—"Taking foam technology to a new level," pp. 1-6, Date Printed: Dec. 23, 2008.

* cited by examiner

HEAT TRANSFER SYSTEM INCLUDING TUBING WITH NUCLEATION BOILING SITES

CROSS-REFERENCE TO RELATED APPLICATIONS

This application claims benefit of U.S. Provisional Patent Application Ser. No. 61/003,142, filed Nov. 13, 2007, which application is hereby incorporated by reference in its entirety.

TECHNICAL FIELD

The principles disclosed herein relate generally to metallic heat transfer tubes including nucleate boiling sites on outer surfaces thereof and uses thereof in various heat transfer applications, particularly in humidification steam dispersion applications.

BACKGROUND

In submerged chiller refrigerating applications, the outside of a heat transfer tube is normally submerged in a refrigerant to be boiled, while the inside conveys liquid, usually water, which is chilled as it gives up its heat to the tube and refrigerant. In a boiling application such as a refrigerating application, it is desirable to maximize the overall heat transfer coefficient.

In order to maximize the heat transfer coefficient, it is known to make modifications to the outside surface of a heat transfer tube in order to take advantage of the phenomenon known as "nucleate boiling". According to one example, the outer surface of a heat transfer tube may be modified to produce multiple pockets (i.e., cavities, openings, enclosures, boiling sites, or nucleation sites) which function mechanically to permit small vapor bubbles to be formed therein. The vapor bubbles tend to form at the base or root of the nucleation site and grow in size until they break away from the outer surface. Upon breaking away, additional liquid takes the vacated space and the process is repeated to form other vapor bubbles. In this manner, the liquid is boiled off or vaporized at a plurality of nucleate boiling sites provided on the outer surface of the metallic tubes.

According to one example, the external enhancement is provided by successive cross-grooving and rolling operations performed after finning of the tubes. The finning operation, in a preferred embodiment for nucleate boiling, produces fins while the cross-grooving and rolling operation deforms the tips of the fins and causes the surface of the tube to have the general appearance of a grid of generally flattened blocks. The flattened blocks are wider than the fins and are separated by narrow openings between the fins. The roots of the fins and the cavities or channels formed therein under the flattened fin tips are of much greater width than the surface openings so that the vapor bubbles can travel outwardly through the cavity and through the narrow openings. The cavities and narrow openings and the grooves all cooperate as part of a flow and pumping system so that the vapor bubbles can readily be carried away from the tube and so that fresh liquid can circulate to the nucleation sites.

It is desirable to use heat transfer tubes having surface enhancements in the form of nucleation sites in other types of heat transfer applications where maximizing the overall heat transfer coefficient is important.

SUMMARY

The principles disclosed herein relate to a heat transfer system that includes a humidification steam dispersion system comprising a steam chamber configured to communicate in an open-loop arrangement with a first steam source for supplying steam to the steam chamber, wherein the steam chamber includes a steam exit for supplying steam to air at atmospheric pressure and a heat transfer tube configured to communicate in a closed-loop arrangement with a second steam source for supplying steam to the heat transfer tube, wherein the heat transfer tube is configured to vaporize condensate forming within the heat transfer system back to steam supplied to the air via the steam exit. The heat transfer tube is configured to contact the condensate and vaporize the condensate back into steam. The heat transfer tube includes a plurality of nucleation boiling sites that are formed by pockets defined on an outer surface of the tube, the pockets including pocket exit/entry portions (i.e., pores) having a smaller cross-sectional area than the cross-sectional area of the pockets at the root portions adjacent the outer surface of the tube.

According to another aspect of the disclosure, the disclosure is related to a heat transfer system that includes a humidification steam dispersion system that uses a higher pressure steam heat exchanger within a lower pressure steam humidification chamber to pipe unwanted condensate away from the steam humidification chamber, wherein the steam heat exchanger forms a closed loop arrangement with a pressurized steam source and the steam heat exchanger includes a heat transfer tube comprising nucleate boiling sites defined on the outer surface of the tube for boiling the condensate.

A variety of additional inventive aspects will be set forth in the description that follows. The inventive aspects can relate to individual features and combinations of features. It is to be understood that both the foregoing general description and the following detailed description are exemplary and explanatory only and are not restrictive of the broad inventive concepts upon which the embodiments disclosed herein are based.

DETAILED DESCRIPTION

Figure 1:
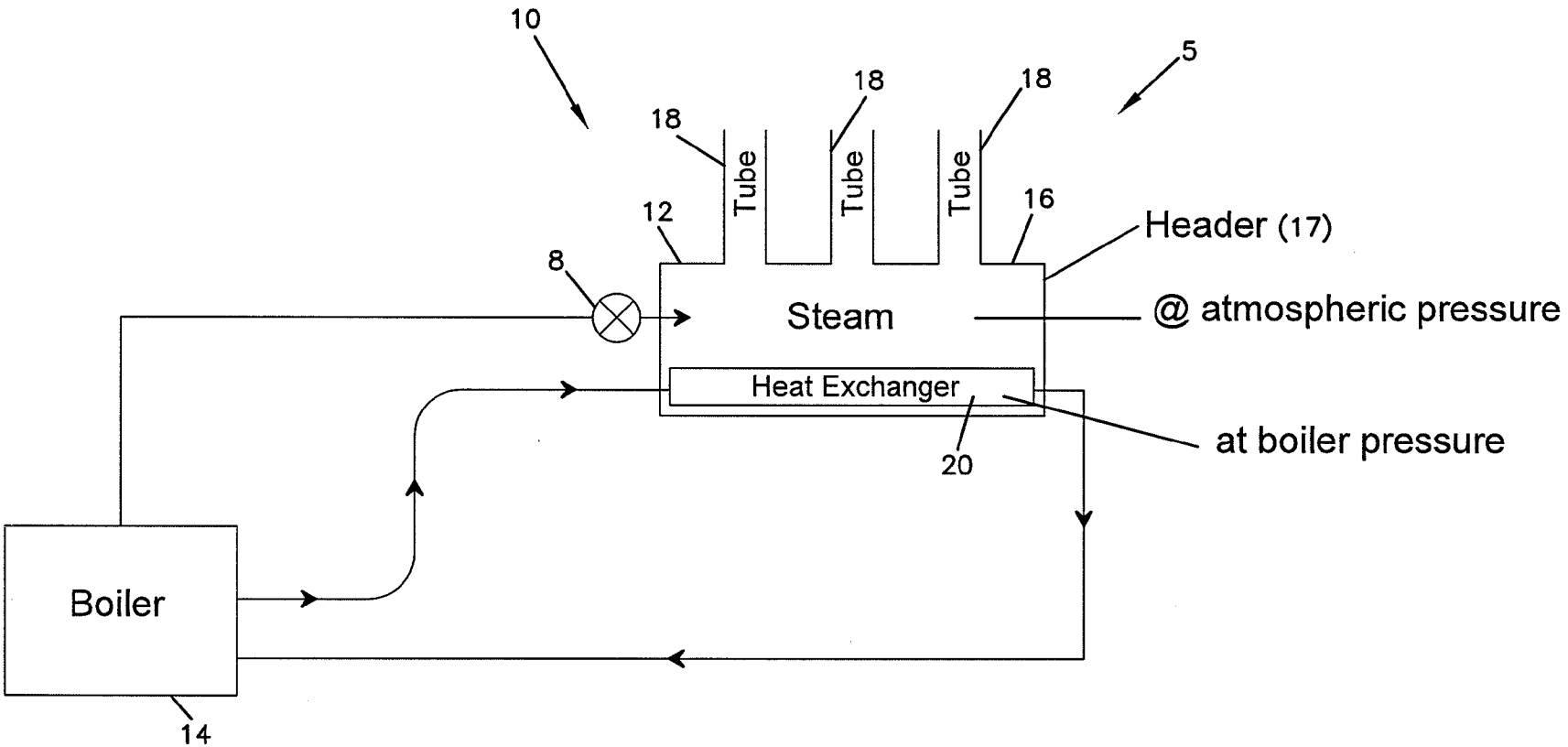
FIG. 1 is a diagrammatic view of a heat transfer system having features that are examples of inventive aspects in accordance with the principles of the present disclosure.
Figure 2:
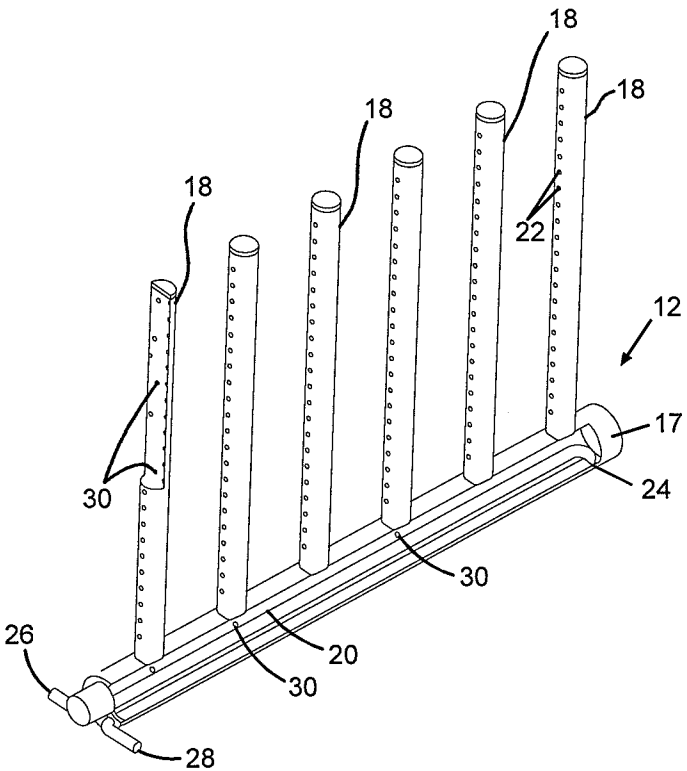
FIG. 2 is a perspective view illustrating a portion of the heat transfer system of FIG. 1, wherein a portion of a central steam dispersion manifold has been cut-away to expose the internal features thereof.

A heat transfer system 5 having features that are examples of inventive aspects in accordance with the principles of the present disclosure is illustrated in FIGS. 1 and 2. In the present disclosure, the heat transfer system 5 is depicted as a humidification steam dispersion system 10. As will be described in greater detail below, the steam dispersion system 10 utilizes a heat transfer tube 11 that includes nucleate boiling sites on an outer surface thereof, wherein the tube 11 is used for boiling unwanted condensate/water off portions of the steam dispersion system 10. The heat transfer tube 11 used in the steam dispersion system 10 includes a plurality of pockets defined on an outer surface of the tube, the pockets including pocket exit/entry portions 50 (i.e., pores) having smaller cross-sectional areas than the cross-sectional areas of the pockets at the root portions thereof, adjacent the outer surface of the tube 11.

It is desirable in a system such as the steam dispersion system 10 shown in FIGS. 1 and 2 to efficiently vaporize condensate/water formed on parts of the system 10. In a humidification process, steam is normally discharged from a steam source as a dry gas. As steam mixes with cooler air (e.g., duct air), some condensation takes place in the form of water particles. Within a certain distance, the water particles are absorbed by the air stream. The distance wherein water particles are completely absorbed by the air stream is called absorption distance. Before the water particles are absorbed into the air within the absorption distance, water particles collecting on steam dispersion equipment may adversely affect the life of such equipment. Thus, a short absorption distance is desired.

It should be noted that a humidification steam dispersion system such as the one illustrated and described herein is simply one example of a heat transfer system wherein a heat transfer tube defining nucleate boiling sites on an outer surface thereof may be used for boiling or vaporizing condensate/water. Heat transfer systems having other configurations wherein tubes with nucleate boiling sites are used for condensate or water boiling purposes are certainly possible and are contemplated by the inventive features of the present disclosure.

In FIG. 1, the steam dispersion system 10 is shown diagrammatically. In FIG. 2, a portion of the steam dispersion system 10 is shown. FIG. 2 shows a central steam manifold 16 with a plurality of steam dispersion tubes 18 extending therefrom, wherein a portion of the central steam manifold 16 has been cut-out to expose and illustrate a heat exchanger 20 therein. As will be discussed in further detail, the heat exchanger 20 is formed from a heat transfer tube that defines nucleate boiling sites on an outer surface thereof. The heat transfer tube 11 is shown in greater detail in FIGS. 3 and 4.

Still referring to FIGS. 1 and 2, the steam dispersion system 10 includes a steam dispersion apparatus 12 and a steam source 14. The steam source 14 may be a boiler or another steam source such as an electric or gas humidifier. The steam source 14 provides pressurized steam towards the manifold 16 of the steam dispersion apparatus 12. In the depicted example, the pressurized steam passes through a modulating valve 8 for reducing the pressure of the steam from the steam source 14 to about atmospheric pressure before it enters the manifold 16. Steam dispersion tubes 18 coming out of the manifold 16 disperse the steam to the atmosphere at atmospheric pressure.

In the embodiment illustrated in FIGS. 1 and 2, the manifold 16 is depicted as a header 17. A header is generally understood in the art to refer to a manifold that is designed to distribute pressure evenly among the tubes protruding therefrom.

In accordance with the steam dispersion system 10 of FIGS. 1 and 2, the steam source 14 also supplies steam to the heat exchanger 20 (i.e., evaporator) located within the header 17. The steam supplied to the heat exchanger 20 is piped through a continuous loop with the steam source 14. The steam supplied by the steam source 14 is piped through the system 10 at a pressure generally higher than atmospheric pressure, which is normally the pressure within the header 17. In this manner, pumps or other devices to pipe the steam through the system 10 may be eliminated.

Although illustrated as being the same, it should be noted that the steam source supplying steam to the header 17 and the steam source supplying steam to the heat exchanger 20 may be two different sources. For example, the source that supplies humidification steam to the header 17 may be generated by a boiler or an electric or gas humidifier which operates under low pressure (e.g., less than 1 psi.). In other embodiments, the source that supplies humidification steam to the header 17 may be operated at higher pressures, such as between about 2 psi and 60 psi. In other embodiments, the humidification steam source may be run at higher than 60 psi. The humidification steam that is inside the header 17 ready to be dispersed is normally at about atmospheric pressure when exposed to air.

The pressure of the heat exchanger steam is normally higher than the pressure of the humidification steam. The heat exchanger steam source may be operated between about 2 psi and 60 psi and is configured to provide steam at a pressure higher than the pressure of the humidification steam to be dispersed. The heat exchanger steam source may be operated at pressures higher than 60 psi.

Although in the depicted embodiment, the internal heat exchanger 20 is shown as being utilized within a header, it should be noted that the heat exchanger 20 of the system 10 can be used within any type of a central steam chamber that is likely to encounter condensate, either from the dispersion tubes 18 or other parts of the system 10. A header is simply one example of a central steam chamber wherein condensate dripping from the tubes 18 is likely to contact the heat exchanger 20.

FIG. 2 illustrates in detail the steam dispersion apparatus 12 of the steam dispersion system 10 of FIG. 1. The steam dispersion apparatus 12 includes the plurality of steam dispersion tubes 18 extending from the single header 17. The header 17 receives steam from the steam source 14 and the steam is dispersed into air (e.g., duct air) through nozzles 22 of the steam tubes 18. As discussed above, the humidification steam inside the header 17 communicating with the tubes 18 may be at atmospheric pressure, generally at about 0.1 to 0.5 psi and at about 212 degrees F. In other embodiments, the steam inside the header 17 may be at less than 1 psi.

Still referring to FIG. 2, in the embodiment of the dispersion system 10, the steam dispersion apparatus 12 includes the heat exchanger 20 within the header 17. In the depicted embodiment, the heat exchanger 20 is formed from continuous closed-loop piping that communicates with the steam source 14. The portion of the heat exchanger 20 within the header 17 includes a U-shaped configuration 24 that generally spans the full length of the header 17. In the depicted embodiment, the steam heat exchanger 20 is generally located at a bottom portion of the header 17. Steam at steam source pressure (e.g., boiler pressure) is supplied to the heat exchanger 20 and enters the heat exchanger 20 via an inlet 26. As discussed above, the steam entering the heat exchanger 20 may generally be at about 2-60 psi and at about 220-310 degrees F. In certain embodiments, the steam provided by the steam source 14 may be at about 15 psi. In certain other embodiments, the steam provided by the steam source 14 may be at about 5 psi. In other embodiments, the steam provided by the steam source 14 may be at no less than about 2 psi. In yet other embodiments, the steam provided by the steam source may be at more than 60 psi. The steam within the heat exchanger 20 is piped therethrough and exits the heat exchanger 20 through an outlet 28.

Although the heat exchanger 20 is depicted as a U-shaped tube according to one embodiment, other types of configurations that form a closed-loop with the steam source 14 may be used. Additionally, the tube 11 forming the heat exchanger 20 may take on various profiles. According to one embodiment, the tube of the heat exchanger 20 may have a round cross-sectional profile. The steam heat exchanger 20 may be made from various heat-conductive materials, such as metals. Metals such as copper, stainless steel, etc., are suitable for the heat exchanger 20.

As discussed above, according to the inventive features of the disclosure, the heat exchanger 20 is made from a tube that includes a plurality of nucleate boiling sites defining pockets on the outer surface of the tube. After formation, the pockets define pocket exit/entry portions 50 having smaller cross-sectional areas than the cross-sectional areas of the pockets at the root portions thereof, adjacent the outer surface of the tube 11. The nucleate boiling sites assist in vaporizing condensate at a higher efficiency than with tubes having smooth exterior surfaces.

Figure 3:
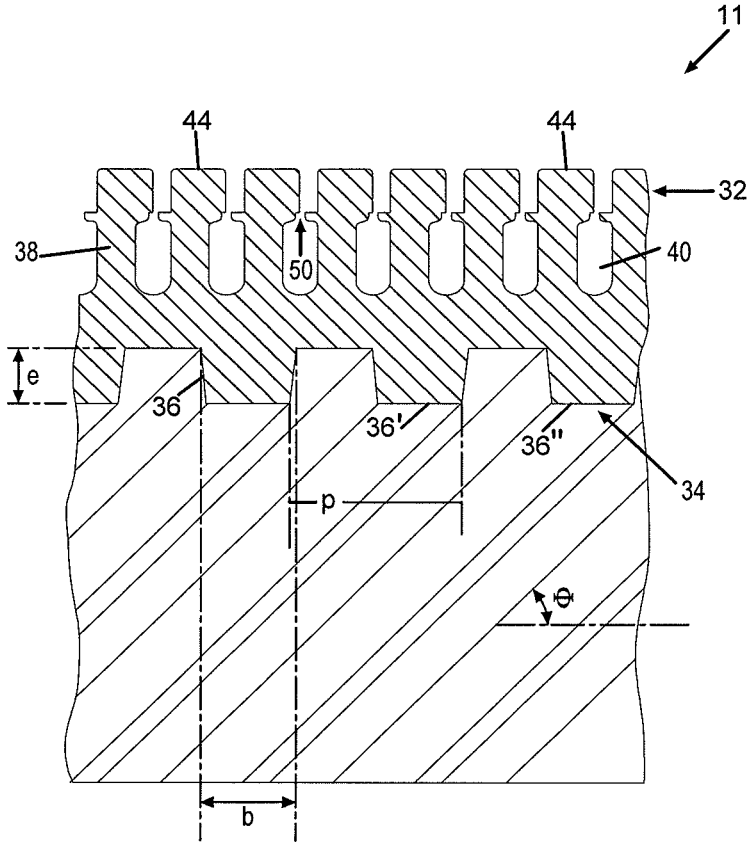
FIG. 3 is an enlarged, partially broken away axial cross-sectional view of a heat transfer tube suitable for use in the heat transfer system of FIG. 1.
Figure 4:
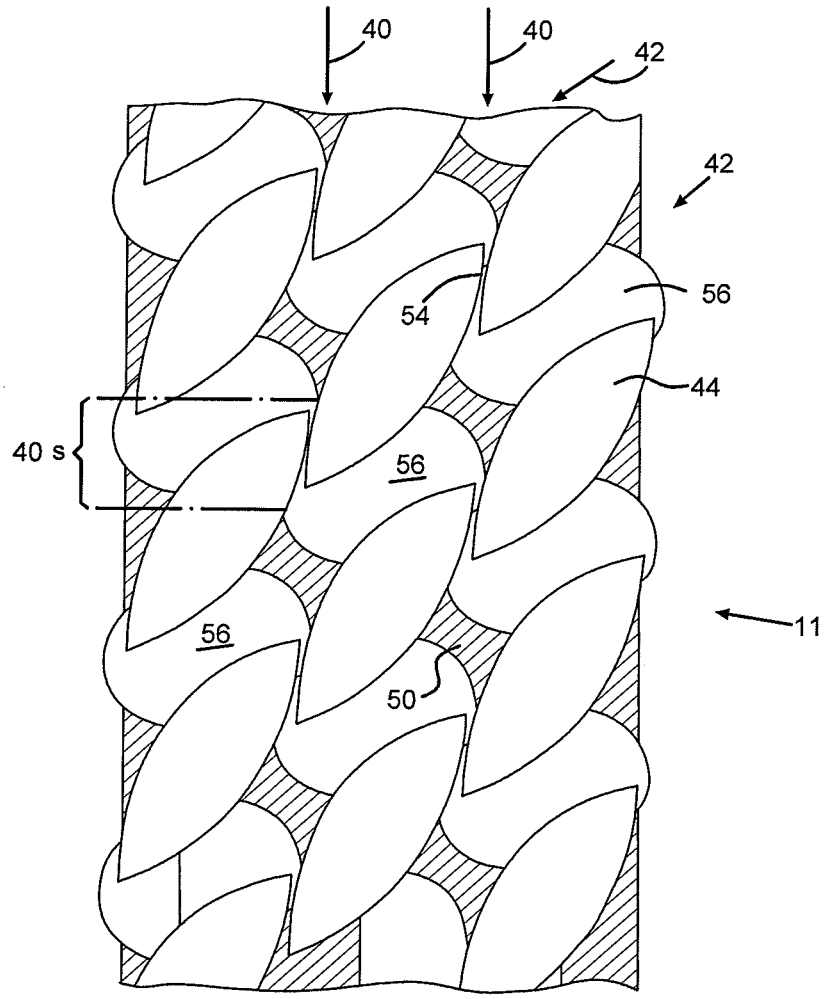
FIG. 4 is a schematic depiction of the outer surface of the tube of FIG. 3.

One embodiment of a heat transfer tube 11 defining nucleate boiling sites on the outer surface that is suitable for use with the steam dispersion system 10 is shown in FIGS. 3 and 4.

Referring now to FIG. 3, in the depicted embodiment, the tube 11 comprises a deformed outer surface indicated generally at 32 and a deformed inner surface indicated generally at 34. According to one example, the tube 11 of the FIGS. 3 and 4 may have a nominal outer diameter of about ¾ inches. According to another embodiment, the tube may have an outer diameter of about 1 inch. According to yet another embodiment, the tube may have an outer diameter of about ⅝ inches.

According to the depicted embodiment, the inner surface 34 of tube 11 comprises a plurality of helically formed ridges, indicated by reference numerals 36, 36', 36" (generically referred to as ridges 36). Ridges 36 define a pitch "p", a ridge width "b" (as measured axially at the ridge base), and an average ridge height "e". A helix lead angle θ is measured from the axis of the tube.

According to one embodiment, the tube 11 shown in FIG. 3 includes thirty-four ridge starts, a pitch of 0.0516 inches, and a ridge helix angle of 49 degrees. These parameters of the tube 11 enhance the inside heat transfer coefficient of the tube by providing increased surface area. It should be noted that these parameter values are only exemplary and other values may certainly be used depending upon the heat transfer characteristics desired.

As discussed above, the outer surface 32 of the tube 11 is deformed to produce nucleate boiling sites. In order to form the nucleate boiling sites, first, a plurality of fins 38 are provided on the outer surface 32 of tube 11. Fins 38 may be formed on a conventional arbor finning machine. The number of arbors utilized depends on such manufacturing factors as tube size, throughput speed, etc. The arbors are mounted at appropriate degree increments around the tube 11, and each is preferably mounted at an angle relative to the tube axis. The finning disks form a plurality of adjacent, generally circumferential, relatively deep channels 40 (i.e., first channels), as shown in FIGS. 3 and 4.

After fin formation, outer surface 32 of tube 11 is notched (i.e., grooved) to provide a plurality of notches 56 forming relatively shallow channels 42 (e.g., second channels), as shown in FIG. 4. The notching may be accomplished using a notching disk as known in the art. As shown in FIG. 4, second channels 42 interconnect adjacent pairs of first channels 40 and are positioned at an angle to the first channels 40.

After notching, fins 38 are compressed using a compression disk resulting in flattened fin heads 44. The appearance of the tube outer surface 32 after compression with flattened fin heads 44 is shown in a plan view in FIG. 4. The cross-sectional appearance is shown in FIG. 3.

According to one embodiment, a typical notch depth, into the fin tip, before any flattening is performed, is about 0.015 inches. According to the same embodiment, after flattening, the depth measured from the final outside surface is about 0.005 inches. According to one embodiment, the notches 56 are spaced around a circumference of each fin 38 at a pitch which is in a range of between 0.0161 to 0.03 (as measured along the circumference of fin 38 at a base of the notches), and preferably in a range of 0.020 inches to 0.025 inches. Adjacent notches 56 are non-contiguously spaced apart so that a flattened fin 44 is intermediate neighboring pores 50.

Referring back to FIG. 4, pores 50 are shown as being at the intersection of the first channels 40 and the second channels 42 and being at the bottom of the second channels 42. Each pore 50 (i.e., the reduced cross-sectional portion of a pocket) defines a pore size (e.g., cross-sectional area), which is the size of the opening from the boiling or nucleation site from which vapor escapes to a water bath. According to one embodiment, the fins 38 are so spaced, and channels 42 so formed, whereby pores 50 have an average area less than 0.00009 square inches. Preferably, the pore average sizes for tube 11 are between 0.000050 square inches and 0.000075 square inches.

According to one embodiment, the pores 50 have a density of about at least 2000 per square inch of tube outer surface 32. Preferably, the pore density exceeds 3000 per square inch and is on the order of about 3112 pores per square inch according to a preferred embodiment. The number of pores per square inch depends on tube wall thickness under the fins. With the preferred 3112 number of pores, for example, a wall thickness of 0.025 inches may be present. If a tube with a 0.035 inch or heavier wall was manufactured, the fin count would tend to increase. In referring to pore average cross-sectional area, it is recognized that fabrication techniques such as finning may result in some pore sizes being greater than 0.00009 square inches. However, a vast majority of the pores depicted herein have an average area of less than 0.00009 square inches.

According to one embodiment, the spacing of the fins 38 of the tube 11 of FIGS. 3 and 4 is sixty-one fins per inch. Thus, according to the same embodiment, the plurality of helical fins 38 are axially spaced at a pitch less than 0.01754 inches (i.e., more than fifty-seven fins/in), and preferably less than 0.01667 inches (i.e., more than sixty fins/in).

Factors such as the notch pitch and number of fins per inch influence the number of pores per square inch on the outside surface of the tube.

The tube 11 has mechanical enhancements which can individually improve the heat transfer characteristics of either the tube outer surface 32 or the tube inner surface 34, or which can cooperate to increase the overall heat transfer efficiency between the outer surface 32 and the inner surface 34. The tube internal enhancement, which comprises the plurality of closely spaced helical ridges 36, provides increased surface area. The tube external enhancement, which is provided by successive grooving and compression operations performed after a finning operation, assists in nucleate boiling. The finning operation produces fins 38 while the grooving (e.g., notching) and compression operations cooperate to flatten tips of fins 38 and cause the outer surface 32 of the tube 11 to have the general appearance of a grid of generally flattened ellipses, as shown in FIG. 4.

Between pores 50, underneath flattened tips 44 of fins 38, each channel 40 defines a channel segment 40*s*, as shown in FIG. 4, which is enclosed from above by the flattened tips 44 of fins 38. The flattened ellipses are wider than pre-compressed fins 38. After formation, the flattened ellipses end up being separated by narrow openings 54 between fins 38 and by the first channels 40 that are at an angle thereto. The roots of the fins 38 and the channels 40 formed therein under the flattened fin tips 44 are of greater width than the pores 50, so that vapor bubbles can be formed at nucleation sites in the cavities/pockets (e.g, beneath pores 50) and then travel outwardly from cavities formed by channels 40 and through the narrow pores 50. Pores 50 are shown (partially covered by notched and flattened fins) in FIG. 4. The cavities and narrow openings and the grooves all cooperate as part of a flow and pumping system so that the vapor bubbles can be formed and readily carried away from the tube 11 and so that fresh liquid can circulate to the nucleation sites. The rolling operation is performed in a manner such that the cavities produced will be in a range of sizes with a size distribution predominately of the optimum size for nucleate boiling of a particular fluid (such as water according to the present disclosure) under a particular set of operating conditions.

Thus, in accordance with the present disclosure, a heat transfer tube is formed which includes surface enhancements of both its inner and outer tube surfaces, and which can be produced in a single pass in a conventional finning machine.

The heat transfer tube 11 illustrated in FIGS. 3 and 4 and described herein is described in further detail in U.S. Pat. No. 5,697,430, incorporated by reference herein in its entirety. Other configurations of heat transfer tubes suitable for the heat transfer system disclosed herein that include nucleate boiling sites formed by pockets defined on an outer surface of the tube wherein the pockets include pocket exit/entry portions having a smaller cross-sectional area than the cross-sectional area of the pockets at the root portions adjacent the outer surface of the tube are described in U.S. Pat. Nos. 4,660,630; 3,768,290; 3,696,861; 4,040,479; 4,438,807; 7,178,361; 7,254,964, the entire disclosures of which are incorporated herein in their entireties.

Now referring back to FIGS. 1 and 2, in operation of the heat transfer system 5, dispersed humidification steam condenses inside the steam dispersion tubes 38 when encountering cold air, for example, within a duct. Condensate 30 that forms within the dispersion tubes 18 drips down via gravity toward the heat exchanger 20 located at the bottom of the header 17. The condensate 30 contacts the exterior surface of the tube of the heat exchanger 20 and is vaporized (i.e., reflashed back into the system). The energy required to turn the fallen condensate 30 back into steam creates condensate within the heat exchanger 20. The energy to vaporize the condensate comes from condensing an equivalent mass of steam within the heat exchanger 20. However, since the interior of the heat exchanger 20 is under a higher pressure, i.e., the pressure of the steam source 14, the condensate created therewithin is moved through the system 10 under this higher pressure, without the need for pumps or other devices.

In the depicted embodiment, the heat exchanger 20 is shown to span generally the entire length of the header 17 so that it can contact condensate 30 dripping from all of the tubes 18. In other embodiments, the heat exchanger 20 may span less than the entire length of the header (e.g., its length may be ½ of the header length or less).

It should be noted that the heat exchanger 20 could be located at a different location than the interior of a header 17. The interior of the header 17 is one example location wherein condensate 30 forming within the steam dispersion system 10 may eventually collect. Other locations are certainly possible, so long as the steam within the heat exchanger 20 is at a higher pressure than atmospheric pressure and so long as the condensate forming within the heat exchanger 20 is able to contact the heat exchanger 20 for piping through the system 10. Please refer to patent application, entitled "HEAT EXCHANGER FOR REMOVAL OF CONDENSATE FROM A STEAM DISPERSION SYSTEM", being concurrently filed herewith on the same day, the entire disclosure of which is incorporated herein by reference, for further configurations of steam dispersion systems utilizing a heat exchanger such as the heat exchanger 20 shown in the present disclosure.

With the configuration of the steam dispersion system 10 of the present disclosure, the resulting condensate may be moved efficiently through the system 10 without the use of pumps or other devices.

As noted previously, a humidification steam dispersion system such as the one illustrated and described herein is simply one example configuration of a heat transfer system wherein a heat transfer tube defining nucleate boiling sites on an outer surface thereof may be used to boil or vaporize condensate/water. Other heat transfer system configurations are certainly possible and are contemplated by the inventive features of the present disclosure.

For example, according to another example heat transfer system, a heat exchanger defining nucleate boiling sites on an outer surface thereof may be used within a chamber that holds water, wherein the water would be boiled by steam running through the heat exchanger. The vaporized water would then be dispersed as humidification steam through a steam outlet of the chamber. In such a steam dispersion system, instead of the chamber receiving humidification steam directly from a steam source such as a boiler, clean, chemical-free water could be used within the chamber for creating the humidification steam.

Other systems such as those described above, wherein a heat transfer tube defining nucleate boiling sites on an outer surface thereof is used to boil or vaporize condensate/water are certainly possible and contemplated by the inventive features of the present disclosure.

The above specification, examples and data provide a complete description of the inventive features of the disclosure. Many embodiments of the disclosure can be made without departing from the spirit and scope thereof.

The invention claimed is:

1. A heat transfer system comprising:

a steam chamber configured to communicate in an open-loop arrangement with a first steam source for supplying steam to the steam chamber, the steam chamber including a steam exit for supplying steam to air at atmospheric pressure; and a heat transfer tube configured to communicate in a closed-loop arrangement with a second steam source for supplying steam to an interior surface of the heat transfer tube, the heat transfer tube configured to vaporize condensate forming within the heat transfer system back to steam that is supplied to the air via the steam exit, wherein an outer surface of the heat transfer tube is configured to contact the condensate and vaporize the condensate back into steam, the heat transfer tube including a plurality of pockets formed on the outer surface of the tube, each pocket including a pocket exit/entry portion having a smaller cross-sectional area than the cross-sectional area of the pocket at a root portion thereof adjacent the outer surface of the tube, wherein the first steam source and the second steam source are the same source.

2. A heat transfer system according to claim 1, wherein the steam chamber includes a header and a plurality of steam dispersion tubes protruding out of the header, the plurality of steam dispersion tubes defining the steam exit, the heat transfer tube located within the header.

3. A heat transfer system according to claim 1, wherein the heat transfer tube includes helical ridges formed on the interior surface of the tube.

4. A heat transfer system according to claim 1, wherein the heat transfer tube is made out of copper.

5. A heat transfer system according to claim 1, wherein the heat transfer tube is mounted outside of the steam chamber.

6. A heat transfer system according to claim 1, wherein at least one of the first steam source and the second steam source provides steam at a pressure of about 2 psi to about 60 psi.

7. A heat transfer system according to claim 1, wherein the second steam source is configured to supply steam to the heat transfer tube at a pressure higher than atmospheric pressure.

8. A heat transfer system according to claim 1, wherein the density of the pockets formed on the outer surface of the tube is at least 2000 pockets per square inch.

9. A heat transfer system according to claim 1, wherein an outer diameter of the heat transfer tube is about 1 inch.

10. A heat transfer system according to claim 1, wherein the cross-sectional area of the pocket exit/entry portion is less than about 0.000090 square inches.

11. A heat transfer system according to claim 10, wherein the cross-sectional area of the pocket exit/entry portion is between about 0.000050 and 0.000075 square inches.

12. A heat transfer system comprising:

a steam chamber configured to communicate in an open-loop arrangement with a first steam source for supplying humidification steam to the steam chamber, the steam chamber including a plurality of steam dispersion tubes protruding out of the steam chamber, the plurality of steam dispersion tubes configured to be directly in contact with air and configured to supply the humidification steam to the air at atmospheric pressure; and a heat transfer tube configured to communicate in a closed-loop arrangement with a second steam source for supplying steam to an interior surface of the heat transfer tube, wherein the first steam source and the second steam source are the same source, the second steam source configured to supply steam to the heat transfer tube at a pressure higher than atmospheric pressure, the heat transfer tube positioned below all of the plurality of steam dispersion tubes for contacting via gravity any condensate forming within the steam dispersion tubes and converting the condensate back to humidification steam that is supplied to the air via the steam dispersion tubes;

wherein the heat transfer tube includes a plurality of pockets formed on the outer surface of the tube, each pocket including a pocket exit/entry portion having a smaller cross-sectional area than the cross-sectional area of the pocket at a root portion thereof adjacent the outer surface of the tube.

* * * * *